United States Patent [19]

Sjogren

[11] Patent Number: 4,514,996

[45] Date of Patent: May 7, 1985

[54] SLIDING DOOR LOCK

[75] Inventor: C. Norman Sjogren, San Gabriel, Calif.

[73] Assignee: Belwith International, Ltd., City of Industry, Calif.

[21] Appl. No.: 562,100

[22] Filed: Dec. 16, 1983

[51] Int. Cl.[3] ..... E05B 65/08

[52] U.S. Cl. ..... 70/100; 70/134; 292/147; 292/DIG. 46

[58] Field of Search ..... 70/99, 100, 129, 134; 292/147, 150, DIG. 46

[56] References Cited

U.S. PATENT DOCUMENTS

| | | | |
|---|---|---|---|
| 2,100,622 | 11/1937 | Adams | 292/147 |
| 2,264,962 | 12/1941 | Adams | 292/147 |
| 2,468,406 | 4/1949 | Mora | 292/153 X |
| 2,991,643 | 7/1961 | Hitt | 70/134 |
| 4,168,854 | 9/1979 | Fujitaki | 292/139 X |

FOREIGN PATENT DOCUMENTS

| | | | |
|---|---|---|---|
| 434924 | 9/1935 | United Kingdom | 292/147 |

*Primary Examiner*—Gary L. Smith
*Assistant Examiner*—Thomas J. Dubnicka
*Attorney, Agent, or Firm*—Robert R. Thornton

[57] ABSTRACT

A sliding door lock in which a bolt is longitudinally slidable by manual movement of a handle to which the bolt is connected so that the bolt is axially rotatable to prevent the cutting of the bolt when locked. The handle slides linearly along a base plate to move the bolt between opened and closed positions. A bullet latch in the handle engages detents on the base plate to hold the handle and bolt in the open and closed positions. A key-operated barrel lock has a barrel groove through which the bolt passes when the lock is in the unlocked position, and the bolt has a circumferential constriction which receives the barrel lock barrel when the barrel lock is rotated to its locked position, thereby preventing movement of the handle and bolt to the open position.

6 Claims, 10 Drawing Figures

10
14
18
20
22
24
26
26A
28
32
32A
34
36
36A
38
40
42
46
48
50
52
54
56
58
60
62
64
66
68
70
72
74
78
80
82
84
86
88
a

SLIDING DOOR LOCK

BACKGROUND OF THE INVENTION

The present invention relates to a door lock in which a sliding bolt is reciprocally movable between a closed position and an open position by a linear longitudinal movement of a handle to which the bolt is attached.

There have been provided in the prior art various constructions in which a bolt is slidable by a pivoted handle, and in which the bolt may be selectively locked into the extended or locking position thereof by a key-operated barrel lock.

U.S. Pat. No. 4,168,854 shows a lock assembly in which a bolt is slidable by rotation of a pivoted handle connected to the bolt by a toggle link pin connected to the bolt and handle. The handle is channel-shaped in cross section, and covers the toggle link in the locked position. The handle rotates through 180 degrees to move the bolt between open and closed positions. A key operated barrel lock contained in a housing through which the bolt passes has an exterior groove enclosing a portion of the bolt when the barrel lock is in the open position, and the bolt has a construction which receives the key-operated barrel lock when the bolt is in the closed position to lock the bolt. A flexible pin depends from the bolt, and in the open position engages a stop on the housing plate to stop further withdrawal of the bolt from the housing.

Three disadvantages of such a device are: the bolt is not rotatable axially, thereby permitting sawing of the bolt to break open the locked door; when the lock is in its locked position, the handle can be rotated open by about twenty-five degrees thereby allowing an intruder the opportunity to pry off the lock; and, when the lock is in its open position, the handle extends downwardly an excessive amount, exposing the toggle elements to view, creating an esthetically unpleasant appearance. Additionally, the toggle type configuration inherently produces a more complex locking structure than is provided by a longitudinally slideable handle structure and may be difficult to open when in its closed position due to the necessity of pulling outwardly on the smooth handle to overcome the toggle over-center action.

SUMMARY OF THE INVENTION

According to the present invention, a sliding door lock especially adapted for patio doors has a bolt, and a substantially flat, generally rectangular base plate having an upstanding body disposed at one end of the plate. The body has a longitudinal guide passsage extending therethrough for guiding the bolt when disposed therein between an open position and a closed position. A rotary barrel lock is mounted in the housing so as to extend into a portion of the passage so as to be selectively operable to engage a construction on said bolt in a locked position when the bolt is in its closed position to lock the bolt against longitudinal movement. A channel-shaped handle has a pair of flanges inwardly disposed one along each of the channel edges to engage the base plate so as to hold the handle thereto in linear longitudinal slidable engagement therewith. Means are provided for fastening the bolt to the handle so that the bolt is axially rotatable and extends through said guide aperture. The handle exposes the flat plate when in the open position and covers the flat plate and causes the bolt to extend through and substantially beyond the upstanding body when in the closed position. Means operable to hold the handle selectively either in the open position or in the closed position are provided between the handle and the base plate.

DETAILED DESCRIPTION OF THE PREFERRED EMBODIMENT

Figure 1:
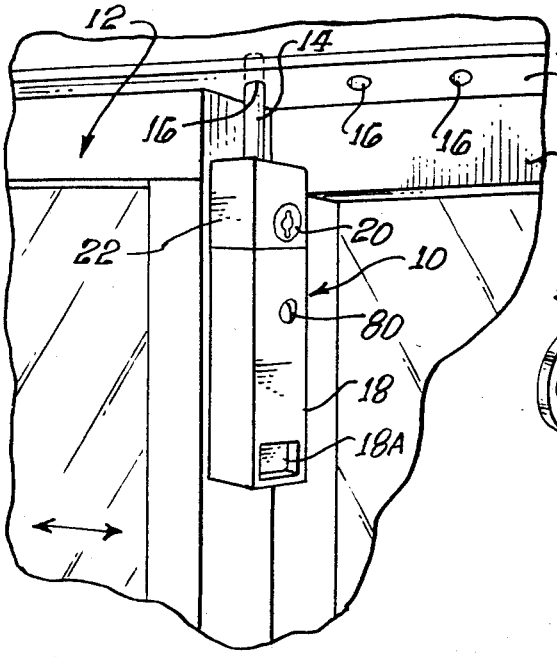
FIG. 1 is an isometric view of a door lock according to the present invention shown from the left front side thereof as mounted on a sliding patio door and disposed in its closed position to prevent the opening of the door.

Referring now to FIG. 1, a sliding door lock 10 according to the present invention is shown as being mounted on a slidable patio door 12. The lock 10 has a bolt 14 shown as extending through one of a plurality of spaced apertures 16 in the door frame casement 17. The door lock 10 includes a handle 18 which is longitudinally moveable between a closed position, as shown in FIG. 1, and an open position, shown in FIG. 2. The door lock 10 has a barrel key lock 20 mounted in a body portion 22 which abuts the handle 18 when in the closed position. As will be apparent from FIG. 1, the bolt 14 may extend through other of the apertures 16 to fix the amount of opening of the door 12 if it is not desired to have the door fully closed.

Figure 2:
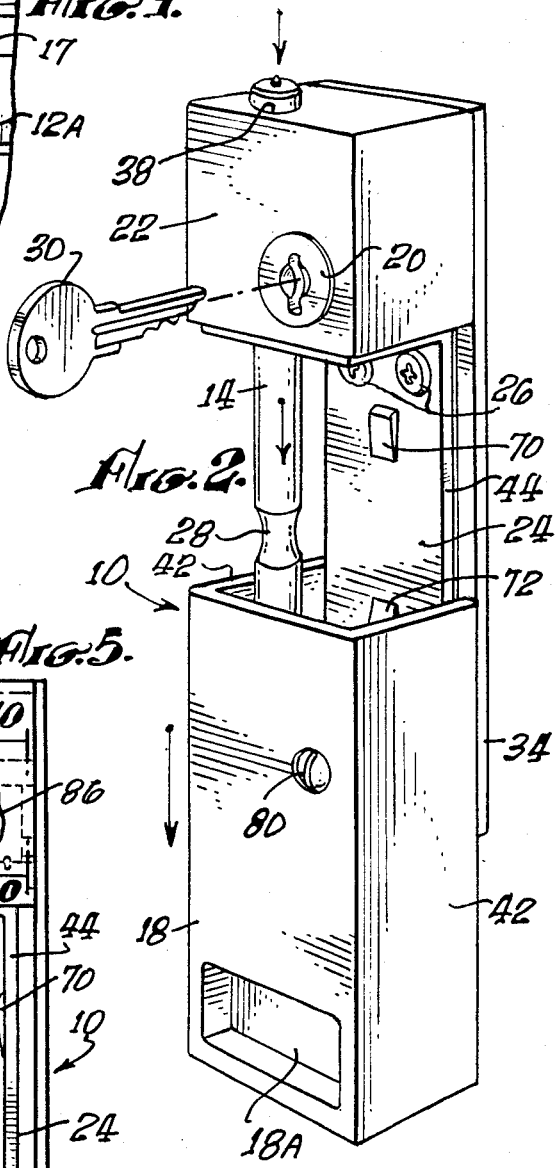
FIG. 2 is another isometric view of the lock of FIG. 1 shown from the right front side thereof, but in its open position.

Referring now to FIG. 2, the door lock 10 is shown in its open position, in which the handle 18 no longer abuts the body portion 22. The bolt 14 is shown in FIG. 2 has having been retracted from the extended position of FIG. 1, in which the bolt 14 extended substantially beyond the body portion 22. The lock 10 has a base plate 24, over which the handle 18 is disposed. The base plate 24 terminates at one end of the body portion 22, which is generally upstanding with respect to the substantially flat and generally rectangular base plate 24. Two of the mounting screws 26 can be seen which extend through the base plate 24 so as to mount the base plate 24 to the door frame. The bolt 14 has a circumferential constriction 28, which functions in conjunction with the barrel lock 20 to lock the door lock 10 in the closed position, as will be described hereafter with respect to FIG. 10. A key 30 is used to rotate the barrel lock 20 to lock and unlock the bolt 14.

Figures 3, 7, 8, 9, 10:
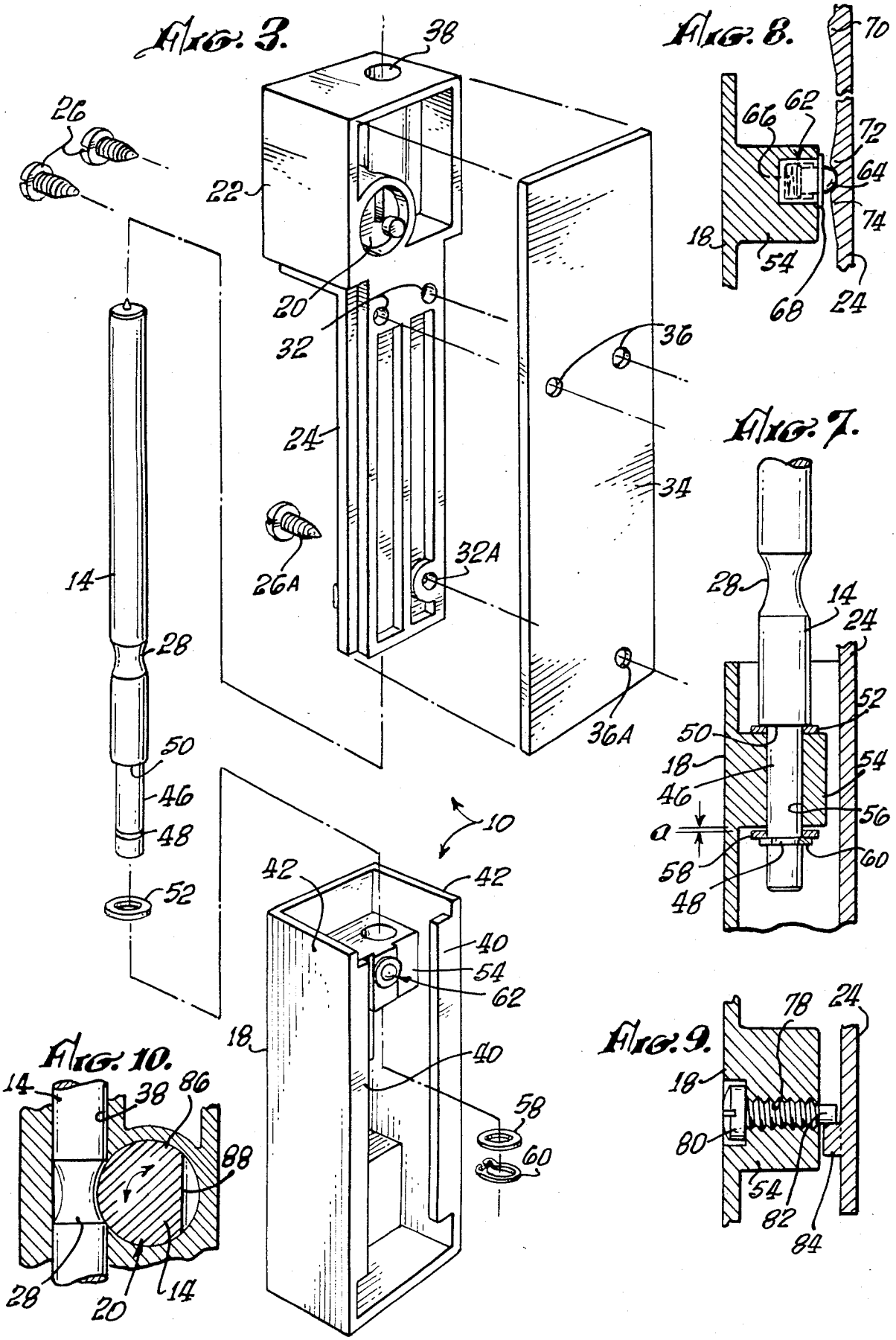
FIG. 3 is an exploded isometric view of the lock of FIG. 1 taken from the underside thereof.
FIG. 7 is a partial sectional view taken along lines 7—7 of FIG. 4.
FIG. 8 is a partial sectional view taken along lines 8—8 of FIG. 4.
FIG. 9 is a partial sectional view taken along lines 9—9 of FIG. 4.
FIG. 10 is a partial sectional view taken along lines 10—10 of FIG. 5.

Referring now to FIG. 3, there is shown an exploded view of the door lock 10. The base plate 24 has a pair of apertures 32 through which the mounting screws 26 pass. A third aperture 32A is located in the base plate 24 remote from the upstanding body portion 22 and a third mounting screw 26A passes through the aperture 32A to provide additional mounting strength for the lock 10. A template and mounting plate 34 has apertures 36 corresponding in location to the apertures 32 of the base plate 24 and an aperture 36A corresponding in location to the base plate aperture 32A. The template and mounting plate 34 is used to mark the position on the door for making the requisite holes to be drilled in the door frame to mount the lock 10 and is placed under the base plate 24 when actually fastening the lock 10 to the door.

The upstanding body portion 22 has a longitudinal guide passage 38 which extends therethrough and which contains the bolt 14 when the lock 10 is in its assembled condition. The handle 18 is generally channel shaped in transverse cross-sectional configuration with edges 42 and has a pair of inwardly extending flanges 40 disposed one each along the channel 42 edges. The underside longitudinal edges of base plate 24 are rabbeted to form flanges 44, only one of which is shown in FIG. 3. These flanges, combined with mounting plate 34, form grooves to receive the flanges 40 in slidable engagement so that the handle 18 may slide longitudinally in linear movement along the base plate 24 between the closed position shown in FIG. 1 and the open position shown in FIG. 2.

The bolt 14 has a mounting stem 46 formed at one end, which has a peripheral groove 48 formed thereon adjacent the end of the stem 46 remote from the remainder of the bolt 14. The stem 46 terminates at its opposite end in a shoulder 50 formed by the bolt 14 cross section. A washer 52 is disposed on the stem 46 adjacent to shoulder 50. The handle, within the interior thereof, has a housing 54 through which a cylindrical aperture 56 extends so as to receive the bolt stem 46. The washer 52 is disposed between the shoulder 50 and the housing 54 and the peripheral groove 48 is disposed beyond the housing 54 within the handle 18. A second washer 58 is held in position on the stem 46 by a snap ring 60 in the peripheral groove 48 so as to prevent withdrawal of the stem 46 from the housing 54 while permitting axial rotation of the bolt 14 (see FIG. 7.) The housing 54 also contains a bullet latch assembly 62 which functions to hold the door lock in the open and closed position, as will be described with respect to FIG. 8.

Figure 4:
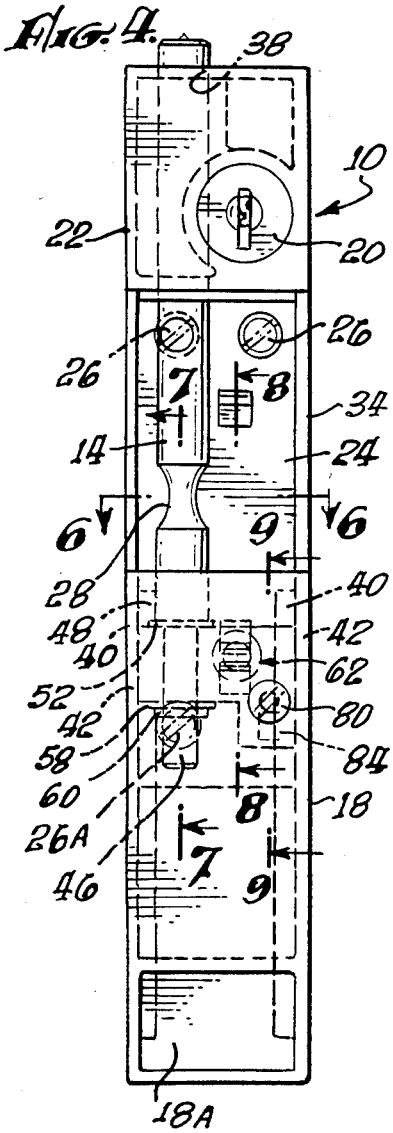
FIG. 4 is a plan view of the sliding door lock of the prevent invention.
Figure 5:
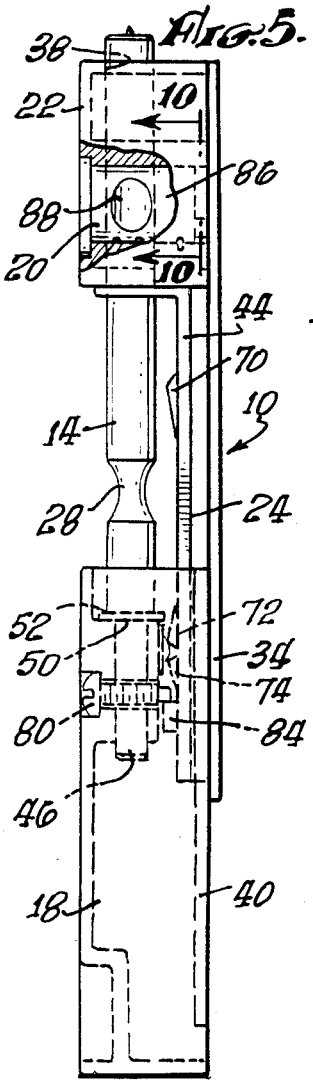
FIG. 5 is a right side elevation of the sliding door lock of the present invention.

Referring now to FIG. 4, a plan view of the lock 10 illustrates the assembled disposition of the various components referred to with respect to FIG. 3. Those components which are disposed within the upstanding body portion 22 and the handle 18 are shown in dotted lines. FIG. 5 is a right side elevation of the lock 10 as shown in FIG. 4, again illustrating the disposition of the components heretofore described.

Figure 6:
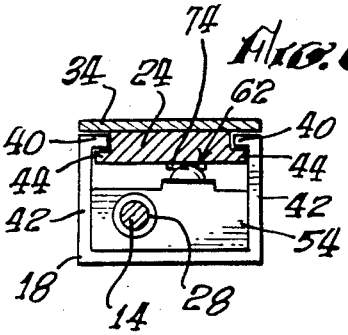
FIG. 6 is a view, in section, taken along lines 6—6 of FIG. 4.

FIG. 6 is a partial sectional view taken along lines 6—6 of FIG. 4. The flanges 40 are shown as being in complementary engagement with the grooves between the flanges on base plate 24 and the mounting plate 34 so as to hold the handle 18 to the base plate 24.

Referring now to FIG. 7, a partial sectional view taken along lines 7—7 of FIG. 4 illustrates the disposition of the washers 52, 58 and snap ring 60 on the bolt stem 46. As will be seen in FIG. 7, the distance between the shoulder 50 and the peripheral groove 48 is selected such that the widths of the washers 52, 58 still leaves a small amount of longitudinal "play" in the bolt mounting to the housing 54, shown as the distance "a". This play insures that the bolt 14 will be axially rotatable. Axial rotation of the bolt 14 is important to avoid easily sawing through the bolt 14 when the lock 10 is in its locked position. Thus an attempt to saw the bolt will result in the bolt rotating with the saw strokes, so as to prevent the saw from biting into the bolt, whereas in the device shown in U.S. Pat. No. 4,168,854 the bolt is fixed axially and may be sawed.

Referring now to FIG. 8, there is shown a partial sectional view taken along lines 8—8 of FIG. 4, illustrating the bullet latch assembly 62 utilized to hold the door lock 10 in its open as well as closed position, even when the extended bolt is not locked. The bullet latch assembly 62 includes a bullet latch 64 urged outwardly by a spring 66 and is held in place by a cover 68. The base plate 24 has a first detent 70 formed thereon adjacent aperture 32 and a second detent 72 and a third detent 74 formed adjacent one another and adjacent aperture 32A. The detents 70, 72, 74 are disposed in linear alignment. As shown in FIG. 8, the bullet latch 64 is disposed in a slot 76 formed between the second detent 72 and the third detent 74. This illustrates the disposition of the handle 18 when the lock 10 is in its open position. When the lock 10 is to be moved to its closed position, the handle 18 is moved linearly so as to override the second detent 72 and such movement is continued until the bullet latch 64 rides over the detent 70, at which point the handle 18 abuts the upstanding housing 22. The bullet latch 64 and detent 70 then hold the lock 10 in its closed position.

Normally, it will not be desirable to permit the handle 18 to be removed from the lock 10 by manually overriding the third detent 74. However, such removal will be necessary during lock installation, since the handle 18 in the open position covers the aperture 32A and the bolt covers one of the apertures 32 (see FIG. 4). Therefore, it is desirable to permit the selective removal of the handle 18 and the bolt 14 from the lock 10. In FIG. 9, which is a partial sectional view taken along lines 9—9 of FIG. 4, the housing 54 is seen to have a threaded aperture 78 formed therein. A threaded fastener 80 having a tip 82 is disposed within the threaded aperture 78 so that its tip 82 engages a stop 84 formed on the base plate 24. The threaded aperture 78 and stop 84 are so disposed with respect to the third detent 74 so as to prevent any substantial overriding of the third detent 74 unless the threaded fastener 80 is rotated so as to withdraw the fastener tip 82 into the threaded aperture 78.

Referring now to FIG. 10, which is a partial sectional view taken along lines 10—10 of FIG. 4, the barrel lock 20 is seen to have a barrel 86 which has a lateral groove 88 formed thereon. The groove 88 normally permits the bolt 14 to slide longitudinally adjacent the barrel 86 as is shown in FIGS. 2 through 9. However, when the lock 10 is in the closed position, as shown in FIG. 10, the constriction 28 on the bolt 14 is adjacent the barrel 86. The barrel lock 20 can then be rotated by means of the key 30 through one hundred eighty degrees so as to rotate the groove 88 away from the constriction 28, thereby causing the barrel 86 and constriction 28 to lock the bolt 14 in the closed position.

As will be apparent from the foregoing description, the lock 10 is installed by using the template and mounting plate 34 as a guide for drilling mounting holes of appropriate size in the sliding door frame. As shown in FIG. 1, the sliding door 12 has a companion door 12A, which is fixed and is the outer door, so that when the door 12 is opened, the door 12A separates the door 12 from the outside. In some installations the door 12 may be fixed and the door 12A slidable. In such event, the lock 10 is mounted on the inner face of the door 12A most remote from the door 12, rather than on the side of the door 12. In either event, if it is desired to lock the door in other than the closed position, additional apertures 16 are drilled in the casement to accommodate the bolt 14 in the desired door opening amounts.

After the mounting holes have been drilled using the template 34, the threaded fastener 80 is rotated so as to withdraw the fastener tip 82 from engagement with the stop 84, thereby permitting the handle 18 to be removed from the lock 10 by overriding the third detent 74. The base plate 24 and template 34 are then mounted to the door frame using the mounting screws 26, 26A. The template 34 serves to prevent scuffing of the door frame by the handle 18. The handle 18 is then remounted on the base plate 24 and moved to either the open or closed position so as to be held in place by the detent 70, 72, 74 and, while so held, the threaded fastener 80 is rotated so as to extend the tip 82 sufficiently to contact the stop 84.

The handle 18 can not then be removed from the lock 10 without unscrewing the threaded fastener 80. When the lock 10 is in its closed position and the key 30 has rotated the barrel lock 20 so as to lock the bolt 14 at the constriction 28, removal of the threaded fastener 80 will not permit removal of the handle 18, because the handle 18 is locked in position by the barrel lock 20, thus providing security against handle removal when the lock 10 is closed and locked. To open the lock 10, the key 30 is then inserted into the barrel lock 20 and rotated so as to align the barrel groove 88 with the constriction 28, thereby permitting the handle 18 to be moved from the closed to the open position by overriding the detents 70, 72. The handle 18 has a finger-pull recess 18A formed therein to facilitate the manual movement of the handle 18 between the open and closed positions.

The invention claimed is:

1. A sliding door lock comprising:

a bolt;

a substantially flat, generally rectangular base plate having an upstanding body disposed at one end thereof, said body including a longitudional guide passsage extending therethrough for guiding the bolt when disposed therein between an open position and a closed position and a rotary barrel lock operable to selectively lock said bolt in a locked position when in the closed position;

a handle which is channel-shaped in transverse cross section and has a pair of inwardly extending flanges disposed one along each of the channel edges to engage the base plate so as to hold the handle thereon in linear longitudinally slidable engagement therewith;

means for fastening said bolt to said handle so that said bolt extends through said guide passage so as to expose the base plate when in the open position and to cover the base plate and cause the bolt to extend through and substantially beyond the upstanding body when in the closed position; and means operable to hold the handle selectively either in the open position or in the closed position.

2. Apparatus according to claim 1 and in which the means for fastening the bolt to the handle is operable to permit axial rotation of the bolt.

3. Apparatus according to claim 1, and in which the means operable to hold the handle selectively either in the open or closed position includes a bullet latch assembly connected between the handle and the base plate, said bullet latch assembly including a bullet latch fixed to either one of the handle or the base plate and a plurality of detents formed in linear alignment on the other thereof so as to receive the bullet latch in a first disposition to hold the handle and bolt in the open position and a second disposition to hold the handle and bolt in the closed position.

4. Apparatus according to claim 2, and in which the means operable to hold the handle selectively either in the open or closed position includes a bullet latch assembly connected between the handle and the base plate, said bullet latch assembly including a bullet latch fixed to either one of the handle or the base plate and a plurality of detents formed in linear alignment on the other thereof so as to receive the bullet latch in a first disposition to hold the handle and bolt in the open position and a second disposition to hold the handle and bolt in the closed position.

5. Apparatus according to claim 3 and including a threaded aperture formed in the handle normal to the base plate, a threaded fastener removably disposed in said threaded aperture, and a stop formed on the base plate so as to extend outwardly therefrom toward the threaded aperture, the threaded fastener and stop being disposed with respect to one another so that, when the handle and bolt are in the open position substantial further longitudinal movement of the handle away from the body is prevented by engagement of the threaded fastener with the stop.

6. Apparatus according to claim 4 and including a threaded aperture formed in the handle normal to the base plate, a threaded fastener removably disposed in said threaded aperture, and a stop formed on the base plate so as to extend outwardly therefrom toward the threaded aperture, the threaded fastener and stop being disposed with respect to one another so that, when the handle and bolt are in the open position substantial further longitudinal movement of the handle away from the body is prevented by engagement of the threaded fastener with the stop.

* * * * *